US010895429B2

(12) United States Patent
Bell

(10) Patent No.: US 10,895,429 B2
(45) Date of Patent: Jan. 19, 2021

(54) PERFECT MARKSMAN—IMPROVED EMBODIMENT OF REMOTE TRIGGER RELEASE FOR FIREARMS

(71) Applicant: Clayton Kyle Bell, Carthage, TX (US)

(72) Inventor: Clayton Kyle Bell, Carthage, TX (US)

( * ) Notice: Subject to any disclaimer, the term of this patent is extended or adjusted under 35 U.S.C. 154(b) by 210 days.

(21) Appl. No.: 16/165,805

(22) Filed: Oct. 19, 2018

(65) Prior Publication Data

US 2019/0186856 A1 Jun. 20, 2019

Related U.S. Application Data

(60) Provisional application No. 62/576,196, filed on Oct. 24, 2017.

(51) Int. Cl.

| | |
|---|---|
| ***F41A 19/08*** | (2006.01) |
| ***F41A 19/09*** | (2006.01) |
| ***F41A 19/10*** | (2006.01) |
| ***F41A 19/55*** | (2006.01) |
| ***F41A 23/02*** | (2006.01) |
| ***F41A 23/16*** | (2006.01) |

(52) U.S. Cl.

CPC ..... *F41A 19/08* (2013.01); *F41A 19/09* (2013.01); *F41A 19/10* (2013.01); *F41A 23/16* (2013.01); *F41A 19/55* (2013.01); *F41A 23/02* (2013.01)

(58) Field of Classification Search

CPC ..... F41A 19/08; F41A 19/09; F41A 19/10; F41A 19/55; F41A 23/02; F41A 23/14; F41A 23/16

USPC .... 42/69.01, 69.02, 69.03, 94, 106; 89/27.3, 89/27.11, 136

See application file for complete search history.

(56) References Cited

U.S. PATENT DOCUMENTS

| | | | | |
|---|---|---|---|---|
| 348,868 | A * | 9/1886 | Straube | F41A 19/09 42/69.01 |
| 3,828,458 | A * | 8/1974 | Skone-Palmer | F41A 19/56 42/69.01 |
| 5,667,524 | A * | 9/1997 | Bourgeois, Jr. | A61B 17/135 606/202 |
| 5,761,954 | A * | 6/1998 | Dvorak | G01L 5/22 73/167 |
| 6,336,283 | B1 * | 1/2002 | Ortiz | F41A 17/02 42/69.01 |
| 6,860,054 | B1 * | 3/2005 | Mosher | F41A 27/24 42/94 |
| 8,522,470 | B2 * | 9/2013 | Mangum | F41C 27/22 42/94 |
| 2007/0256346 | A1 * | 11/2007 | Potterfield | F41A 23/16 42/94 |
| 2009/0158922 | A1 * | 6/2009 | Werner | F41A 19/59 89/136 |
| 2013/0298439 | A1 * | 11/2013 | Mahnke, III | F41A 23/16 42/94 |
| 2016/0047617 | A1 * | 2/2016 | DeGidio | F41A 19/08 42/69.01 |

* cited by examiner

*Primary Examiner* — Joshua E Rodden

(74) *Attorney, Agent, or Firm* — Sorey, Gilliland & Hull, LLP; Derek T. Gilliland

(57) ABSTRACT

A remotely activated trigger release for a firearm is disclosed. The disclosed trigger release can provide immediate disengagement from the firearm when a user ceases interaction with the trigger release. Trigger activation can he achieved by means of a handheld pneumatic pump that pressurizes an expandable member inside a hinged assembly which can provide a force to move the trigger.

7 Claims, 4 Drawing Sheets

PERFECT MARKSMAN—IMPROVED EMBODIMENT OF REMOTE TRIGGER RELEASE FOR FIREARMS

RELATED U.S. PATENT DATA

Patent application Ser. No. 16/165,805 filed Oct. 19, 2018

Provisional Patent Application No. 62/576,196 filed Oct. 24, 2017

Prior art of significant relevance: U.S. Pat. No. 7,587,854 B2

BACKGROUND

Many devices have been created in an attempt to aid firearm users in holding a steady point of aim while firing. These devices and combinations thereof, so far, present the possibility of improvement for offering the market a combination of cost effective stability in point of aim, safety for themselves and safety for their equipment simultaneously. Any device that requires the user to contact the rifle during detonation subjects the point of aim of said rifle to human motion contamination and subjects the user to recoil. Locking firearms into a stationary or heavy vice-like apparatus risks equipment damage during recoil and creates a different point of impact relative to that achieved without using these particular embodiments. In other prior art, the embodiments may provide desired stability while sacrificing in categories such as safety, ease of installation, spectrum of firearms serviced, interchangeability during shooting sessions, assembly time, cost, durability, maintenance, storage requirements, consistency and size. When specifically considering safety, a product capable of requiring the continuous presence of the user as well as a simple, yet continuous, and assertive interaction by said user in order to create the conditions necessary for detonation and furthermore becoming unable to provide detonation in the absence of this presence and interaction would be greatly beneficial to the market.

Rifle users in particular have demonstrated that they provide strong market demand for various devices from rifle rests to electronic remotes as they try to meticulously sight their rifles in safely, without pain and despite many existing handicaps. Below, a simple yet effective solution to increase the efficiency of embodiments of rifle rests already available by offering a new embodiment of remote trigger release is outlined for introduction to an evident market.

BRIEF DESCRIPTION OF THE DRAWINGS

The five drawings are intended to show an efficient embodiment of the invention from multiple viewpoints during its use. It is helpful first to define the two "states" which this machine is seen in the figures. When the machine is in contact with the rifle's trigger and therefore prepared to detonate a round, please consider this an "active state." When the machine is not engaged or in contact with the trigger and is therefore incapable of creating a detonation please consider this an "inactive state. " FIGS. 1 and 5 show the machine in an "inactive" state while FIG. 1 has all of the major components of the machine labeled.

Below is a summary of components of a perferred embodiment.

A—Squeezable Bulb Pump.
B—One-way valve.
C—Safety Valve or Plumbing tee.
D—Flexible tubing.
E—Tubing Transition.
F—Securing mechanism such as a Cinch Loop or Zip-Tie.
G—Spring member such as a Semi-rigid tubing to act as a spring poised to remove said apparatus from the vicinity of the trigger when expandable bladder is not pressurized.
H—Hinged Apparatus with two rigid members hinged together at one end.
I—Hinge pin hingably connecting the two members.
J—Elastic member to retract expandable bladder when not pressurized.
K—Coated (soft) tips to contact with trigger and trigger guard and to maintain a suitable coefficient of friction during contact.
L—Expandable bladder to move the members of the hinged apparatus in relationship to each other.

BRIEF DESCRIPTION

Figure 1:
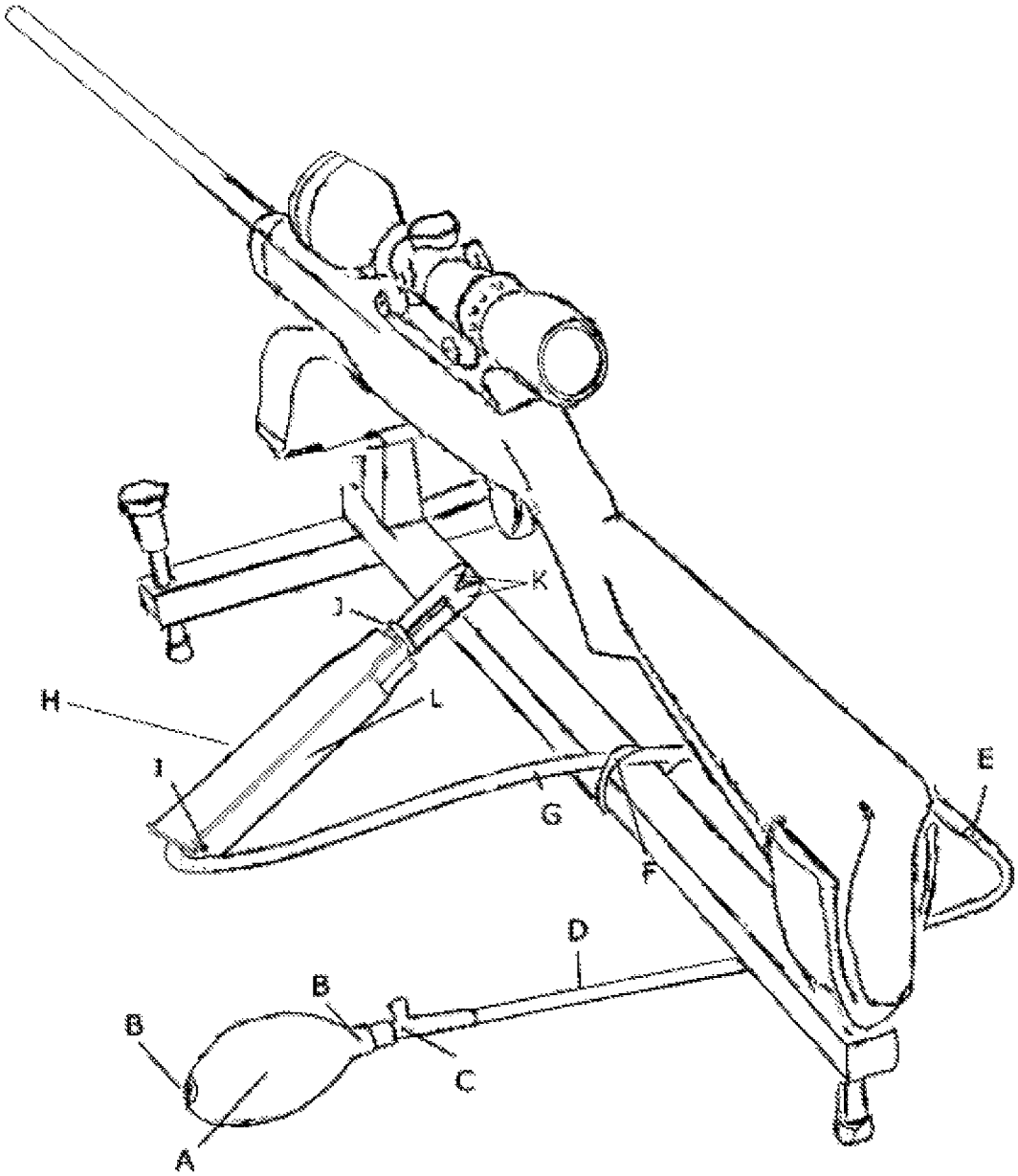

The various devices used to hold the point of aim for a rifle steady could be outfitted with cost effective and safe remote trigger release that separates users from recoil and eliminates the effects of their inevitable motion on the steady point of aim. In FIG. 1, an embodiment has been sketched to demonstrate a device in which a handheld pneumatic pump can pressurize an expandable bladder contained inside of a simple "chopstick style" hinged apparatus which will open said apparatus as bladder is inflated with said pump. The opening end of this apparatus can be used to apply outward pressure to the trigger and trigger guard of a firearm until detonation is achieved. The two sections of conduit for fluid from the pump into the bladder are selected based on specific physical properties. The section immediately connected to the pump is flexible in order not to transmit motion from the user to the rifle during use. The other section is semi-rigid and spring like to allow firm attachment to a stationary object which will allow the spring like properties to remove the hinged apparatus from the vicinity of the trigger when not in use or when pressure is released by user and an elastic band removes the outward force on the trigger and guard. A plumbing tee connects the pump to the flexible tubing with the remaining end left open to the atmosphere. Therefore, in order to build pressure into the bladder, the user must hold their thumb over the open end of this fitting continuously during use or the detonation is aborted and the device removes itself from the trigger as the pressure bleeds back through the opening.

DESCRIPTION OF FEATURED EMBODIMENT

Figure 2:
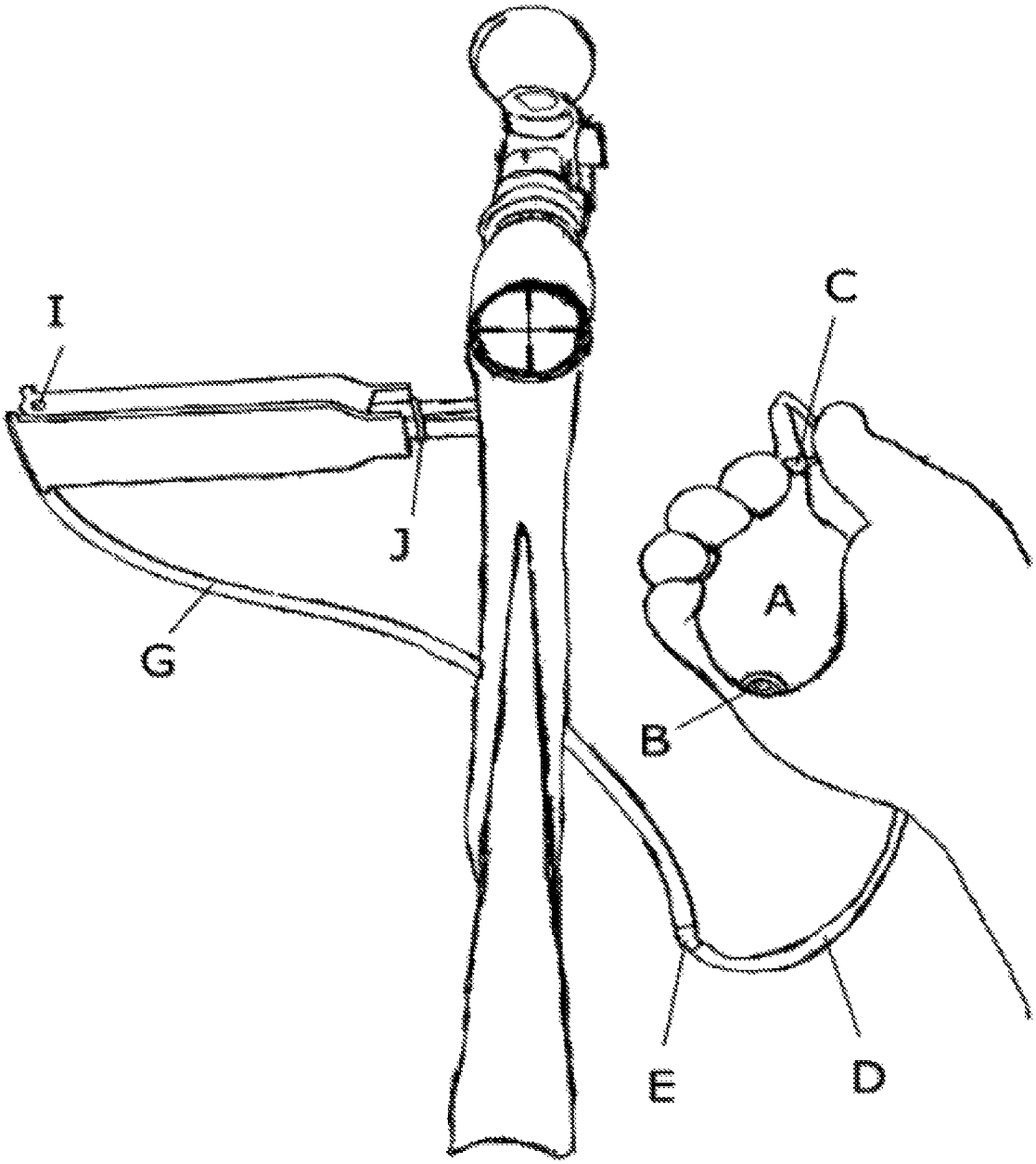
FIGS. 2, 3 and 4 show an "active" state. All of the figures show the machine in the vicinity of a rifle that is rested on either a gun rest or bipod.
Figure 3:
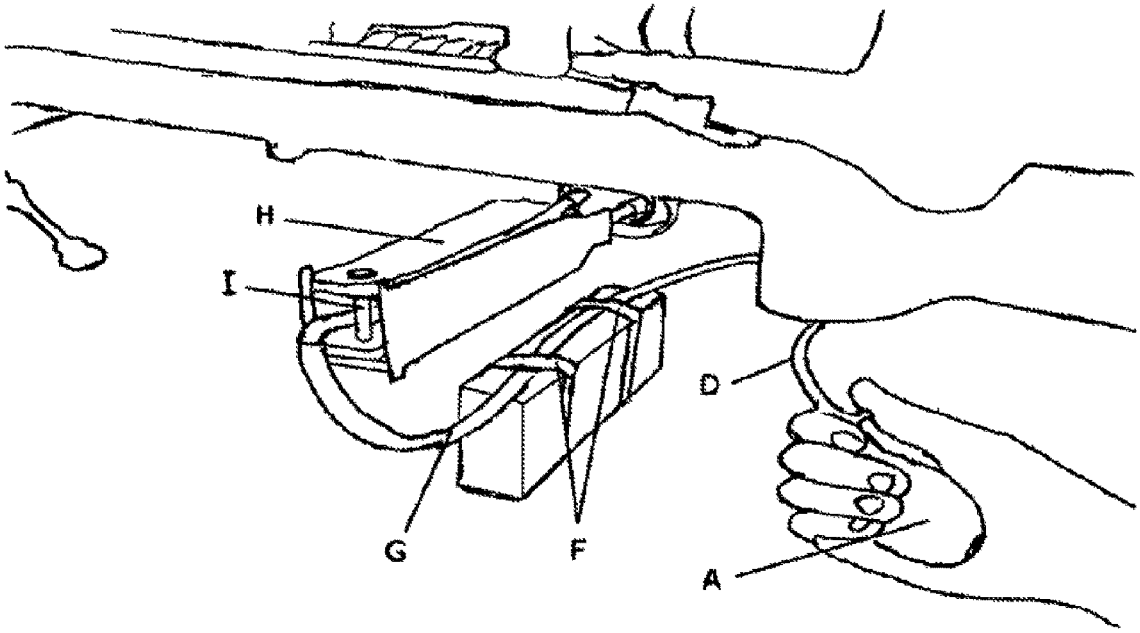
Figure 4:
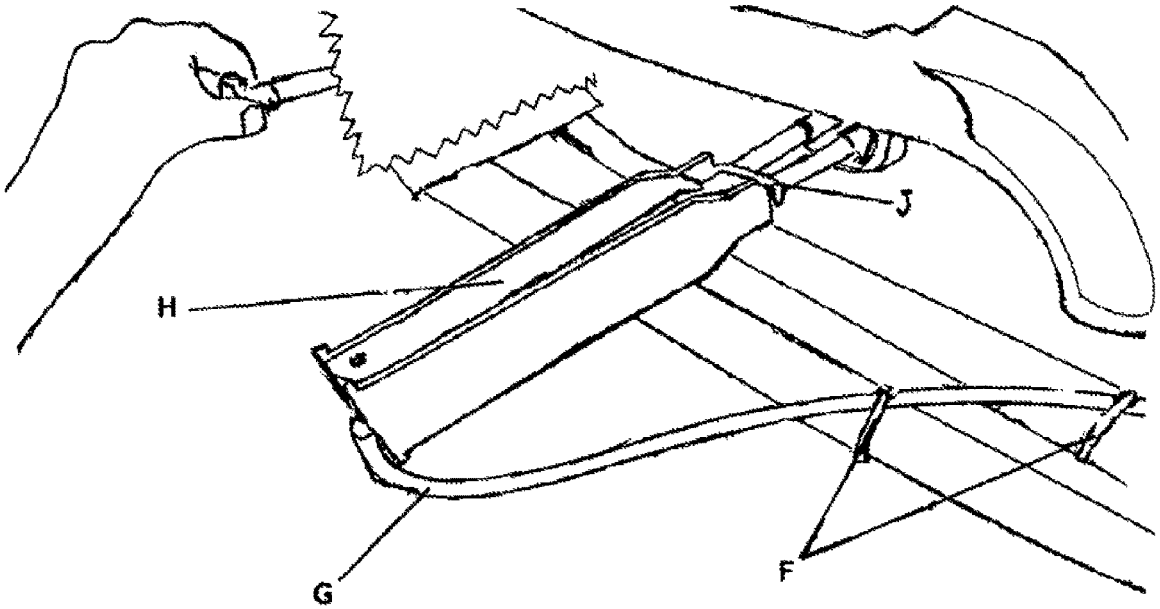
Figure 5:
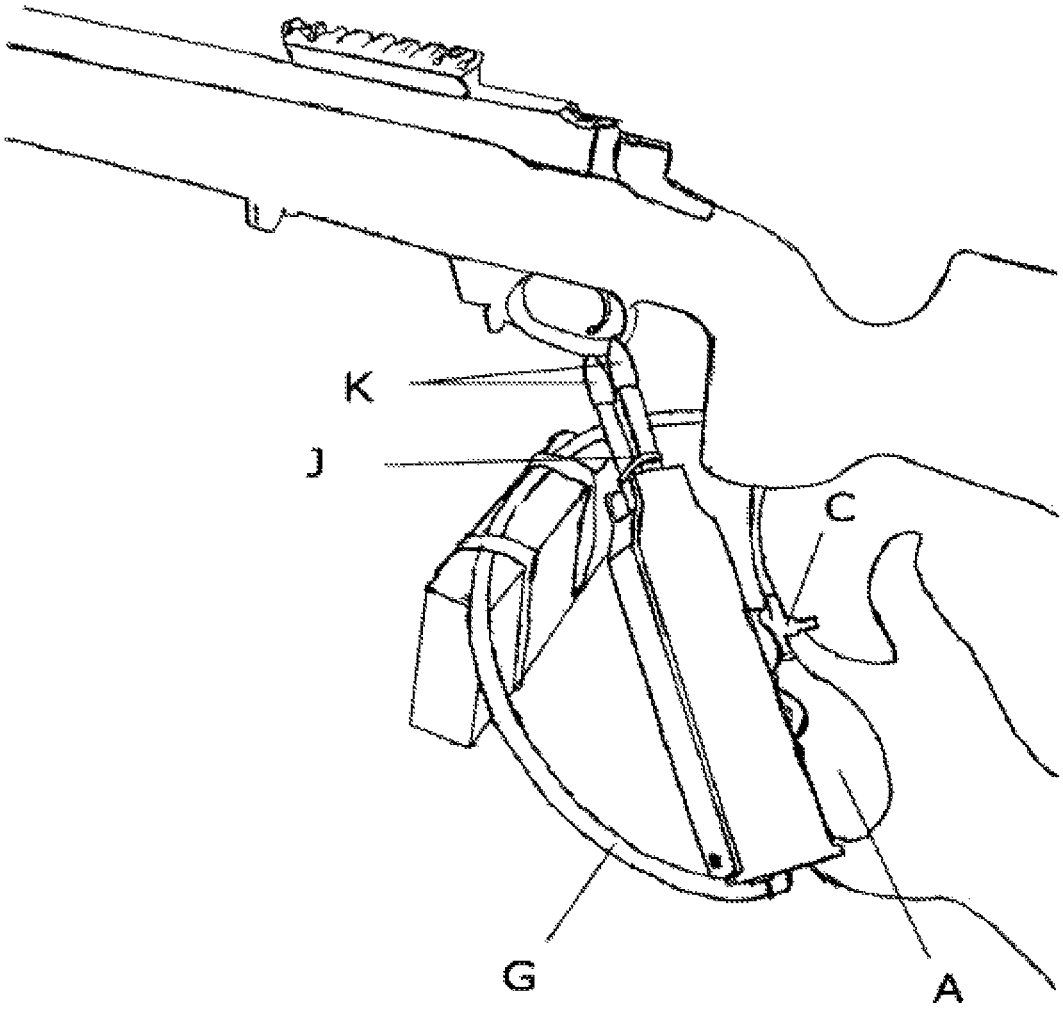

In FIG. 1 you will see an embodiment of the invention while in the inactive state in its entirety shown cinched to a generic gun rest with a rifle present as well. Starting with a pneumatic pump outfitted with safety pressure release comprised of a squeezable bulb (A) with a single inlet and a single outlet where two check valves (B) are inserted to allow fluid flow in one direction from the surrounding atmosphere through the bulb into a connected plumbing "tee" fitting (C). The bulb fits in the palm of the user's hand and the user must place their thumb over a remaining opening in the tee fitting in order to build pressure into the final remaining opening during use or else pressurization is impossible. In the simplest terms, a handheld pneumatic pump with the fluid outlet split having one side left open to the atmosphere and within reach of the user's thumb. In order for pressure to be built and transferred into conduit connected to the other side of this split the user must plug this outlet with their thumb continuously while performing squeezes of the bulb. This pneumatic pump is attached to flexible tubing (D). When air is pushed into the flexible tubing it will pass through a transition (E) into a semi-rigid section of tubing (G) on its way to the hinged apparatus (H). This section of semi-rigid tubing is cinched to the gun rest with a cinch loop (F) which allows it's rigid nature to support the weight of the hinged end of the apparatus when the machine is placed in an active state as well as act as a spring to remove the hinged apparatus from the vicinity of the trigger as the machine transitions from active to inactive automatically if the user ceases to plug the above mentioned branch of the outlet with their thumb. The hinged apparatus is made up of two lightweight and rigid members that are hinged together with a single pin (I) at one end and held closed by an elastic band (J) near the other. Both members of the hinged apparatus have soft coated tips (K) on the ends that are opposite that of the hinge. Between the two solid members of the hinged apparatus there is an inflatable bladder (L) that is hidden from view in this drawing yet connected and in fluid communication with the semi-rigid section of conduit. When pressurization is achieved within this bladder the two rubber-coated ends are forced to separate. In FIG. 1 the device is in a non-active state and is not in contact with the rifle. The user must lift the hinged apparatus to the trigger guard with one hand and engage the pump with the other so that the hinged apparatus is opened slightly by pressurizing the bladder. The two rubber tips will make contact with the trigger and the inside of the trigger guard thus providing support for this opening end of the hinged apparatus while the semi-rigid tubing section attached to the gun rest will support the hinged end of the apparatus while the two tips "grab" the trigger. This section of tubing acts as fluid conduit as well as a spring to remove the apparatus from the vicinity of the trigger when pressure is release and the tips "let go" of the trigger. This is the fundamental difference between the aforementioned "active" verses "inactive" states of this embodiment. FIG. 2 shows the view from the user's perspective while the machine is in an active state. During the active state it will then be possible for the hand that lifted the hinged apparatus to the trigger to become free to adjust the point of aim as is demonstrated in FIG. 3. FIG. 4 shows that this particular embodiment can also be cinched or banded to an alternative stationary object such as a box of ammunition to provide all of the same services to bipod and sandbag setups which are also popular for holding user's rifles steady. Once an active state and proper point of aim are attained, additional pressure can be built into the bladder to achieve sufficient force to the trigger for detonation. At any point during this process the detonation can be aborted and the machine will return to an inactive state free of any contact with the rifle and its trigger if the user simply releases the pump from their hand or lifts their thumb from plugging the open branch of the pump outlet as seen in FIG. 5. During traditional use of a rifle, aborting a detonation is achieved by releasing the pressure from their finger on the trigger. With this particular embodiment the user releases pressure from their thumb on the pump outlet opening. Both cases provide an intuitive single step process and both cases provide an instantaneous abort. The additional steps required by the user to remove a chambered round, manipulate any safety switches on the particular firearm or otherwise achieve a state of safety are unaffected by this embodiment of remote trigger release. It is important to note that prior art requires additional steps to remove pressure on the trigger. Prior art also has the potential to require additional steps for removing a chambered round for example in a lever action rifle that may require its disassembly from the firearm before the lever can be opened.

VARIATIONS OF EMBODIMENTS

Various embodiments of the basic elements are possible. Multiple configurations have been tested in the time since the provisional application was filed. The provisional patent application No. 62/576,196 shows an embodiment with multiple sections of conduit with varying physical properties and functions that it was discovered could be simplified, manufactured and packaged more efficiently while performing the various functions with greater effectiveness. It is possible to strip various aspects of the most effective embodiment tested thus far with relatively obvious tradeoffs that other manufacturers may be willing to sacrifice in an attempt to compete prematurely. The claims outlined below are an attempt to provide protection from such events and the description of the various embodiments imagined and manufactured is also outlined.

Simplification of the device featured in the main description could be put forth as a new embodiment by simply placing an expandable bladder without the described hinged apparatus into the trigger guard that would fall from said trigger guard by means of gravity when the pneumatic pump outfitted with safety valve is disengaged. In the opinion of the inventor this particular embodiment would not provide the "feel" and consistency that the featured embodiment is capable of. This embodiment could be simplified further by removing the safety valve from the pump but the decrease in the efficiency, safety and functionality are self evident.

It is also possible to make the featured embodiment slightly more complicated and possibly more user friendly by placing a spring loaded valve over the branch of the outlet that was left open to the atmosphere. This valve would be open to the atmosphere by default by a spring and closed by pressure from the thumb which would counteract the spring to hold a manufactured cap in place and possibly provide a more consistent seal than the thumb alone when trying to achieve an active state. This embodiment may provide an easier "first time" experience for the user. However, this feature will come with tradeoffs that take away from the safety and cost benefits achieved by the featured embodiment. The costs of this valve relative to the simple opening plugged by a users thumb are evident but not necessarily prohibitive. It is the safety elements that have been considered most concerning with this possible embodiment. Potential for failure of the valve to open when the user released pressure on the spring could result in an inability to abort detonation efficiently if at all. There are more subtle safety concerns for this possible change as well. During testing of prototypes a tendency for the users to familiarize themselves with the operation of the machine more effectively before attempting a detonation was noticed when they were presented with the featured embodiment as opposed to a version with the spring loaded valve.

Various embodiments of pneumatic trigger release can also be attained by combining elements of the prior art (U.S. Pat. No. 7,587,854 B2), namely the slave cylinder assembly, with the pneumatic pump outfitted with safety release described above. These versions will give effective trigger release but add to the time necessary for preparation and assembly by the user as well as safety risks to equipment during recoil and during transport if disassembly is neglected. The prior art could be upgraded with the pneumatic pump with safety release to allow the requirement for hydraulic oil to be removed. Removal or loss of the hydraulic oil in an attempt to achieve pneumatic operation of the prior art was inconsistent at best because the size requirements of a device capable of connecting to the side of the rifle in the rest restricts the diameter of the piston to be used. Cost requirements also restrict the efficiency of a piston that can be air tight and low friction simultaneously. Therefore, since the fluid pressure acts, in an effective manner, only on the diameter of the piston and the use of air as opposed to hydraulic fluid allows substantial compression of the internal fluid before sufficient pressure can be built to move the cost effective piston, multiple failures resulted and a substantially reduced sensitivity is felt unless much expense is devoted to the quality of pistons used to manufacture these devices. The attempt for pneumatic operation with the master and slave cylinder outlined in the prior art resulted in a "sticky" feel and inconsistent level of force necessary on the plunger to achieve detonation. In order to compensate the device will require a larger ratio of master cylinder to slave cylinder volume which results in a decrease in sensitivity or "feel." Using the pneumatic pump instead of the master cylinder allows for an open system with access to extra fluid to address the compressible nature of the air during use and will also provide an instant removal of pressure differential that could be combined with a spring to remove the "finger" from contact with the trigger when the pump is disengaged. However, as assembly to the firearm is required, the above mentioned negative considerations reappear. The ultra-simplified version of this embodiment that could eliminate the need for assembly and also provide automatic disengagement of the firearm would be a very small piston that fits between trigger and guard that simply supports itself when opened sufficiently, actuates trigger when pressurized, and falls out when the user disengages the pump. The size requirements for that particular embodiment would again restrict the diameter of the piston that is usable for the application and reduce the "feel" and sensitivity experienced by the shooter. The longevity, durability and cost effectiveness of a piston of that size were not tested but the ability to find a suitable balance of just those qualities is questionable. These factors are all present, although to a lesser degree, when using a piston to open the featured embodiment's hinged apparatus rather than the expandable bladder. A piston instead of an expandable bladder for substitution in the featured embodiment should be mentioned as a possibility.

Use of the above described pneumatic pump with safety release can improve the flexibility of the prior art by activating the piston with suction and thus contraction rather than expansion of the slave cylinder or piston. The check valves (one-way valves) on the inlet and outlet of the bulb can be reversed to allow suction by the pump and therefore actuate this embodiment by evacuation of fluid from a piston as opposed to the positive pressure differential suggested in the prior art. This feature allows for the prior art to pull as well as push and thus be more flexible on the location where an embodiment can attach to a firearm resulting in an increase of the spectrum of firearms serviced. Embodiments consisting of the slave cylinder outlined by the prior art can thus be outfitted to attach to the firearm at locations behind the trigger on the butt stock as opposed to being limited to clamping to the forearm only.

The use of the hinged apparatus outlined in the featured embodiment outlined in the figures above allows for abolishing the need for assembly to the firearm to achieve remote trigger release. The time necessary for assembling the prior art to the various firearms taken to the rifle range by a user is prohibitive by comparison. Also, during recoil, the prior art is known to become detached from the firearm on occasion thus requiring additional time for reassembly when additional detonations are desired. This feature alone will prove to separate this invention from the prior art in the opinion of the market.

The absence of liquid hydraulic fluid requirement and the increased "feel" and flexibility provided by a pneumatic pump with safety valve during use clearly provide the possibility of a plethora of embodiments that can be considered a separate and original invention as compared to the specific master and slave cylinders described in the claims of U.S. Pat. No. 7,587,854 B2. Additionally, when considering the layout of a firearm supported by a gun rest, the use of an expandable bladder or vessel allows the surface area of force exertion to be larger thus obtaining more efficient and sensitive mechanical force to the trigger. This more efficient harnessing of the necessary energy to complete a safe and consistent trigger release allows us to focus the effects of a device to a small and localized area of the firearm without the need for a clamping assembly thus eliminating time expenditures as well as risks of damage during recoil.

I claim:

1. A remote firearm trigger release apparatus comprising: a hinged member with a first tip to apply a force on a trigger of a firearm, a second tip to engage a trigger guard of said firearm, a hinge coupling the first tip to the second tip and an expandable member coupled to the first tip and second tip configured to apply said force to said trigger in response to pressure from a user controlled hand held pump in fluid communication with said hinged member; and a conduit coupled to the pump and the hinged member to communicate a fluid pressure from the pump to the hinged member, the conduit affixable relative to said firearm and having a spring force to move the hinged member away from the trigger when less than a predetermined fluid pressure is present at the hinged member.

2. An auto-disengaging remote firearm trigger release apparatus comprising:

a) a pump, coupled to a pressure release valve, said valve oriented to prevent unintended pressure build up by releasing pressure without continuous user input; and b) a hinged member coupled to the pressure release valve, the hinged member having a first tip, and a second tip and an expandable member therebetween, wherein the first tip and second tip are proximate to each other in a closed position and move away from each other in expanded positions when pressure is applied to the expandable member; wherein the first and second tips are insertable between a trigger and a trigger guard of a firearm when said hinged member is in the dosed position, the first and second tips configured to contact said trigger and said trigger guard when said hinged member is one of the expanded positions; and c) flexible conduit having a restoring force, with the conduit coupled to said hinged member and couplable to a location relative to said firearm, the restoring force configured to remove the first and second tips from proximity to said trigger and said trigger guard when a pressure in the expandable member of the hinged member is reduced such that a force applied between the trigger and the guard that holds the first and second tip in a firing position is overcome by the restoring force of the conduit.

3. A remote firearm triggering apparatus comprising:

a) a pump; and b) a hinged assembly coupled to said pump having a first and second rigid member coupled together by a hinge at one end, each first and second rigid member having a tip on a distal end, the hinged assembly coupled to an elastic member that is expandable, when being pressurized the elastic member moves the tip of the first member away from the tip of the second member and when being depressurized moves the tip of the first member towards the tip of the second member, wherein when said elastic member is not expanded the tips of said first and second members are insertable between a trigger and a trigger guard of a firearm and when the elastic member is expanded the tips of the first and second member is configured to engage said trigger and said trigger guard; and c) a spring member coupled to the hinged assembly and mountable in a fixed position in relation to the firearm configurable to automatically disengage the hinged assembly from the firearm when a pressure to the elastic member falls below a predetermined level.

4. The remote firearm triggering apparatus as recited in claim 3, further comprising: a safety valve coupled to the pump and the hinged assembly to control a pressure applied to the trigger by the pump via the hinged assembly, wherein sufficient pressure cannot be achieved for the hinged assembly to remain in contact with the trigger without continuous user input to the safety valve.

5. The remote firearm triggering apparatus as recited in claim 4, wherein the safety valve is a three-orifice fitting where one orifice is configured to be suitably sealed by a human finger.

6. The remote firearm triggering apparatus as recited in claim 3, wherein the spring member is attachable to a location on the firearm such that a spring force of the spring member removes the triggering apparatus from being proximate to the trigger when no user input occurs.

7. The remote firearm triggering apparatus as recited in claim 3, further comprising a polymer surface on said tips of the first and second members to prevent damage to the firearm and to control a static friction between said first and second tips and the trigger and trigger guard which allows the tips to stay engaged with the firearm when a first predetermined minimum engage pressure is applied and allows the tips to disengage the trigger and trigger guard when a second predetermined disengage pressure is achieved.

* * * * *